United States Patent [19]

Sylvest

[11] 4,089,634

[45] May 16, 1978

[54] PLANETARY COOLER SYSTEM FOR ROTARY KILN PLANT AND THE LIKE

[75] Inventor: Karl J. Sylvest, Copenhagen, Denmark

[73] Assignee: F. L. Smidth & Co., Cresskill, N.J.

[21] Appl. No.: 705,872

[22] Filed: Jul. 16, 1976

[30] Foreign Application Priority Data

Jul. 23, 1975 United Kingdom ..... 30860/75

[51] Int. Cl.[2] ..... F27D 15/02

[52] U.S. Cl. ..... 432/80; 34/10

[58] Field of Search ..... 432/77, 78, 80, 84; 34/20

[56] References Cited

U.S. PATENT DOCUMENTS

| | | | |
|---|---|---|---|
| 1,653,050 | 12/1927 | Lindhard | 432/80 |
| 3,512,764 | 5/1970 | Jensen | 432/80 |
| 3,539,164 | 11/1970 | Brachthauser | 432/80 |
| 3,745,667 | 7/1973 | Heinemann et al. | 432/80 |

FOREIGN PATENT DOCUMENTS

| | | | |
|---|---|---|---|
| 1,042,729 | 9/1966 | United Kingdom | 432/106 |
| 1,193,529 | 6/1970 | United Kingdom | 432/106 |
| 1,290,639 | 9/1972 | United Kingdom | 432/106 |
| 1,413,055 | 11/1975 | United Kingdom | 432/106 |

*Primary Examiner*—John J. Camby

*Attorney, Agent, or Firm*—Pennie & Edmonds

[57] ABSTRACT

A planetary cooler system is disclosed for cooling hot cement clinker exiting from a rotary kiln having a plurality of cooler tubes mounted in planetary fashion there-about and being adapted to receive material from the rotary kiln into their inlet end portions. A material outlet casing communicates with the planetary cooler tubes and is adapted to receive at least partially cooled hot material from the outlet portion of each cooler tube when its rotational position is at or near its uppermost position. The outlet casing defines two shafts joined at their upper ends and configured and adapted to receive the partially cooled cement clinker from the tubes for passage down through the shafts to cause the outlet casing to act as a shaft cooler, while at least one ventilating device blows or draws cooling air through the casing to provide further cooling of the clinker preferably countercurrently to its passage therethrough. The invention also relates to a rotary kiln plant incorporating the cooler system.

19 Claims, 3 Drawing Figures

PLANETARY COOLER SYSTEM FOR ROTARY KILN PLANT AND THE LIKE

BACKGROUND OF THE INVENTION

1. Field of the Invention

This invention relates to a cooler system for cooling hot material exiting from a rotary drum. In particular, the invention relates to a cooler system for cooling cement clinker exiting from a rotary kiln and a rotary kiln plant incorporating such a system.

2. Description of the Prior Art

Coolers forming part of the prior art may be divided into three main groups: rotary coolers, grate coolers and shaft coolers. Depending upon the type required in a given case, such coolers are generally located at or near the outlet end portion of a rotary kiln for reception of the kiln product for cooling. While grate coolers and shaft coolers are relatively less complex in structure and operation than rotary coolers, the last mentioned coolers have received substantial application because of their effectiveness and efficiency. One type of rotary cooler is the planetary cooler which is comprised of an assembly of cooler tubes mounted or arranged to be mounted in planetary fashion around the axis of the kiln at or near its outlet end portion with the axes of the tubes and the rotary axis of the cooler tubes substantially parallel with the kiln axis. In use, material to be cooled after treatment in the kiln passes from the kiln into one end of the cooler tubes and proceeds axially along the tubes while being cooled by air passing in countercurrent along the tubes.

Since the product exiting the kiln is generally heated to between 1200° - 1400° C., it must obviously be cooled substantially prior to conveying it for further heat treatment in the kiln plant. Depending upon circumstances this cooling may be to temperatures varying from several hundred degrees centigrade to approximately 50° C. To achieve such a substantial cooling it has been known either to use coolers that are very large compared with the size of the plant, or to use a combination of coolers. For example, a planetary cooler may be coupled before a grate cooler, a rotating drum cooler or a shaft cooler. If extremely large coolers are used, the cooling area necessary to achieve the desired cooling will ultimately place a physical limitation on the size of the cooler with which the plant may be furnished, either for reasons of physical impossibility or expedience.

On the other hand, if several coolers are chosen, often undesirable requirements must then be accepted. For example, considerably more plant space will often be required, and technically complicated and costly apparatus such as conveyors and the like for conveying hot clinker from one cooler to the other will also be required. In modern kiln plants, since the entire (or substantially the entire) process of preheating and calcining has been transferred from the rotary kiln proper to special installations such as outside calciners, preheating units and the like, the kiln operation has become limited substantially to the sintering process. Thus, a substantially higher efficiency of the total plant is achieved without increasing the size of the kiln, and it is consequently desirable to attempt to achieve a limited cooler size corresponding to the plant while at the same time retaining the required cooling effect.

Such requirements are particularly important in plants utilizing a planetary cooler rotating with the kiln. For such arrangements, since the individual cooler tubes are attached to the kiln shell and uniformly distributed about its circumference (at or near the outlet end portion of the kiln), the size of the kiln establishes a natural, absolute limit to the size and number of the cooler tubes which may be attached to the outside of the kiln shell. A corresponding limitation of the cooler size is also evident where the planetary cooler is separately mounted and rotatable at a speed which differs from that of the kiln.

Several attempts have been made in the past to achieve an effective cooling of such hot kiln products. British Pat. No. 1,042,729 relates to a kiln apparatus for cooling the kiln product wherein the product is uniformly distributed onto a grate cooler which is fixed below the end of the kiln. The kiln is provided with a number of material discharge openings arranged so that the material is released from each opening as the kiln rotates and the openings pass around the bottom of the kiln.

British Pat. No. 1,193,529 relates to a cooling arrangement for a rotary furnace which produces cement clinker. Kiln product exits the kiln and falls through a shaft where it is cooled by passing air countercurrent through the column of material.

British Pat. No. 1,290,639 relates to a two-stage cooler for the production of cement clinker. Hot kiln product is cooled in a grate cooler and directed to the top of a shaft cooler by means of an elevator where it passes through the shaft cooler and contacts cooling surfaces.

British Pat. No. 1,413,055 relates to a kiln apparatus for producing cement clinker wherein the thermal efficiency and production capacity is sought to be maximized. A rotary kiln is combined with a preheater, planetary cooling cylinders, and a main grate cooler. After exiting the kiln, the clinker is pre-cooled by atmospheric air in the planetary cooling cylinders and then passes onto the grate cooler where cooling air is used to cool the product. The heated cooling air is thereafter supplied to the preheater.

U.S. Pat. No. 1,653,050 to Lindhard relates to a rotary kiln and cooler in which the cooling efficiency is sought to be maximized. Cement clinker is discharged into the cooling section of the kiln while small pieces of cement clinker pass through openings in the kiln when they are in the bottom position of the kiln. The pieces are directed into a drum which is attached to the side of the rotary kiln, passes along the drum, falls into another drum attached to the first drum, and is cooled in the drums by a countercurrent flow of air.

While these attempts have improved somewhat, the efficiency achieved in cooling cement clinker, they nevertheless are not as effective as is desired, particularly for improving the efficiency within the entire structure of the cooler. In addition, they have not achieved any reductions in plant size. I have invented a system of the planetary cooler type for a rotary drum such as a kiln in which the individual cooler tube may be optimized in size according to the kiln size, and in which the desired cooling effect is achieved within the entire structure of the cooler.

SUMMARY OF THE INVENTION

A planetary cooler system for cooling hot material exiting from a rotary drum such as a rotary kiln which comprises a plurality of cooler tubes mounted in planetary fashion about the rotary drum, each tube having an inlet end portion adapted to receive hot material from the rotary drum. A material outlet casing communicates with the planetary cooler tubes and is adapted to receive at least partially cooled hot material from the outlet portion of each tube when the tube is at a predetermined position, the outlet casing defining at least one conduit for reception of the material, and means for controlling a flow of cooling air through the conduit so as to provide further cooling for the material as it passes through the conduit. The outlet casing is particularly positioned and adapted to receive partially cooled material from the planetary cooler tubes when — during their rotation — they are at their uppermost position. Further, the outlet casing incorporates at least one conduit or shaft which is adapted to receive the material and thus acts as a shaft cooler. The casing is provided with at least one ventilating device for blowing or drawing in cooling air through the shaft for further cooling of the material, preferably countercurrently to its passage down through the shaft. In the preferred form, the casing includes two shafts united at their upper end portions, to form a joint connection.

The shaft (or shafts) may have a funnel-shaped channel member at their upper end portions for collecting the partly cooled kiln product from the outlet of the cooler tubes and for conveying the product into the outlet casing. The cooling air added may be caused wholly or partly to by-pass the planetary cooler tubes from the upper part of the outlet casing for other use in the plant. For example, such preheated cooling air may be directed to a calciner and/or preheater coupled before the kiln to which the cooler may be fitted, or it may be fed directly to the kiln for use as combustion air. Alternatively this cooling air may be passed countercurrently to the kiln product through the planetary cooler tubes exclusively and thereafter to the kiln to serve as combustion air.

The outlet casing may be provided with means for controlling the amount of air supplied adjacent to the bottom of the shaft (or shafts) in such manner as to maintain in each shaft, a certain predetermined atmospheric subpressure which is intended to prevent false air from penetrating into the shaft at the seal between the outlet casing and kiln. Further, each shaft may be provided with known means for improving the cooling capacity. For example, louvre dampers may be provided, down which the kiln product may cascade during the countercurrent cooling. Also, a flash-countercurrent cooling device for cooling the finer fraction of the kiln product may be provided. A countercurrent cooling device may take the form of a charge of the kiln product at the lower part of the shaft (or shafts), with air being then passed through the charge. Other cooling devices contemplated include a fluid-bed cooling device for the finer fraction, or means for indirectly cooling the kiln product.

A particular feature of the present invention resides in the fact that a relatively long stay in the cooler section constituted by the outlet casing is achieved for the kiln product by cooling the kiln product countercurrently in the outlet casing of a planetary cooler. Further, by using discharge from each cooler tube in its upper position, simultaneously blowing or drawing cooling air up through the outlet casing improves the total cooling efficiency. This technique utilized a hitherto unheeded cooling advantage which is characteristic of the construction of planetary coolers. That is, the present invention permits a change in the amount of air in the kiln and the cooler tubes as compared with known types of planetary coolers. By rendering it possible to reduce the amount of cooling air in the cooler tubes, a better harmony between kiln and cooler tube dimensions may be achieved, with simultaneous improved cooling capacity as a whole.

The solution enables the planetary cooler tubes to be shortened with a consequent decreased load on the kiln, brackets and/or supports. An improved silencing can be achieved because the cooler tubes thus reduced in size, may be provided throughout their length with a noise-absorbing ceramic lining without reducing the total cooling effect of the combined cooler. Also it is possible with the present invention, to achieve a satisfactory cooling effect by means of such planetary coolers in kiln plants which are adapted or re-built for partly separate calcining. In the past it has been difficult to achieve this cooling effect in these plants with planetary coolers alone. Further by a high-point discharge from the cooler tubes the outlet casing — serving as the shaft cooler — need not, as in conventional shaft coolers, extend downwards very substantially, as for example, into a pit (underground or otherwise) in relation to the kiln outlet.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
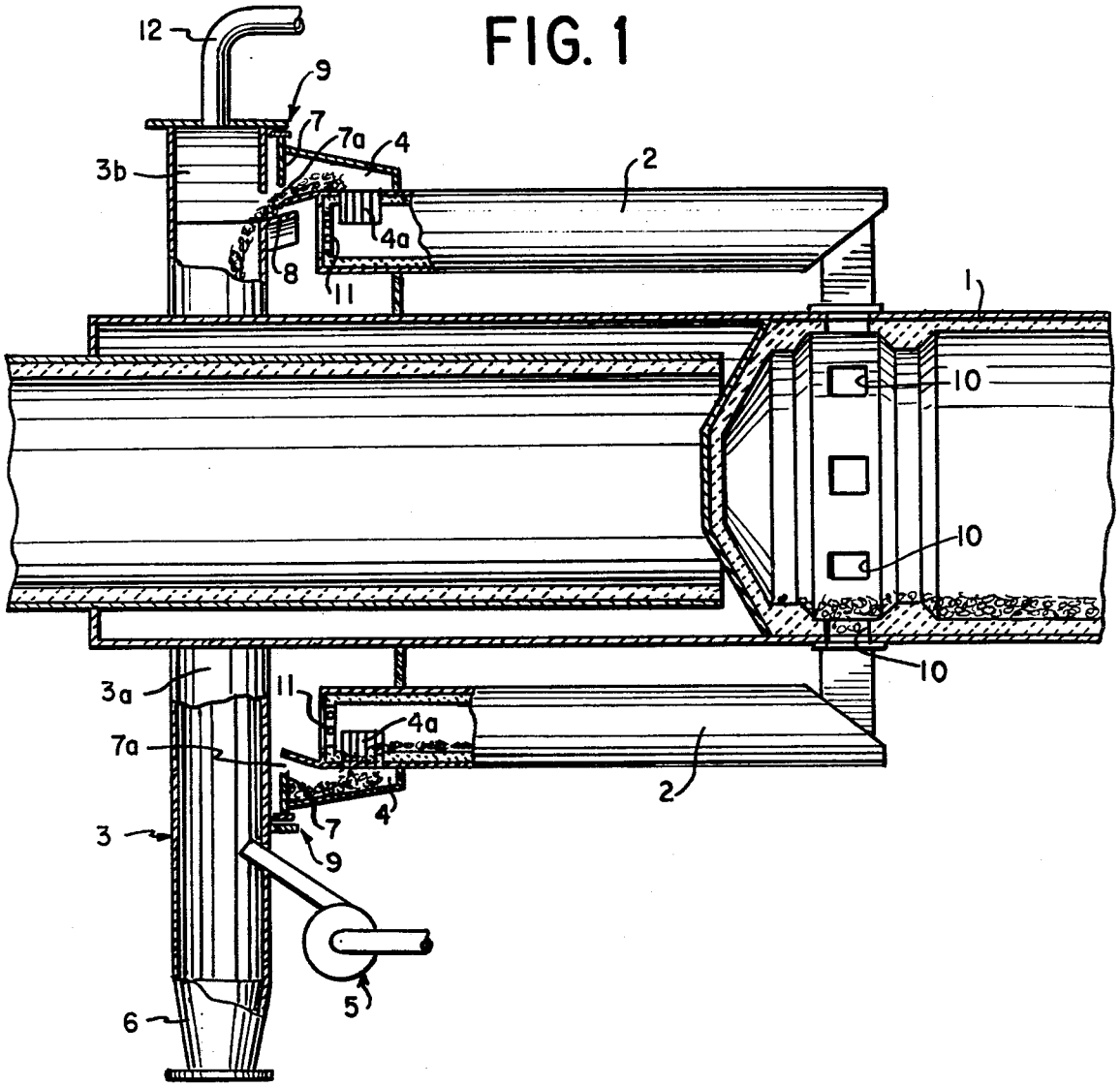
FIG. 1 is a side elevational view, partially in cross-section, of a preferred embodiment of the invention in which part of the cooling air utilized in the outlet casing by-passes the planetary cooler tubes.

The plant shown in the drawings includes a rotary kiln 1, with cooler tubes 2 of a planetary cooler provided at the outlet end portion of the kiln and rotating with same. The tubes are in permanent communication with the kiln 1 through inlets 10, and an outlet casing 3 is provided for reception of the product treated in the kiln and cooler tubes. The outlet casing 3 consists among other things of two shafts **3*a* united at their upper end portions to form a joint connection 3*b*. At the lower end portions, the shafts open into outlets 6. Directly above the shaft outlets 6, cooling air in the form of atmospheric air is blown into each shaft by a fan 5. The cooling air passes up through the shaft parts 3*a* and 3*b* and hence entirely (FIG. 2) or partly (FIG. 1**) through the cooler tubes to the kiln for use as combustion air.

In case of a partial supply of cooling air to the cooler tubes the remaining part of the cooling air is passed from the outlet casing through a tube 12 and is directed for other known uses in the plant. In this case atmospheric air is further sucked as cooling air into the cooler tubes 2 through grates 11 provided in the tubes.

Figure 2:
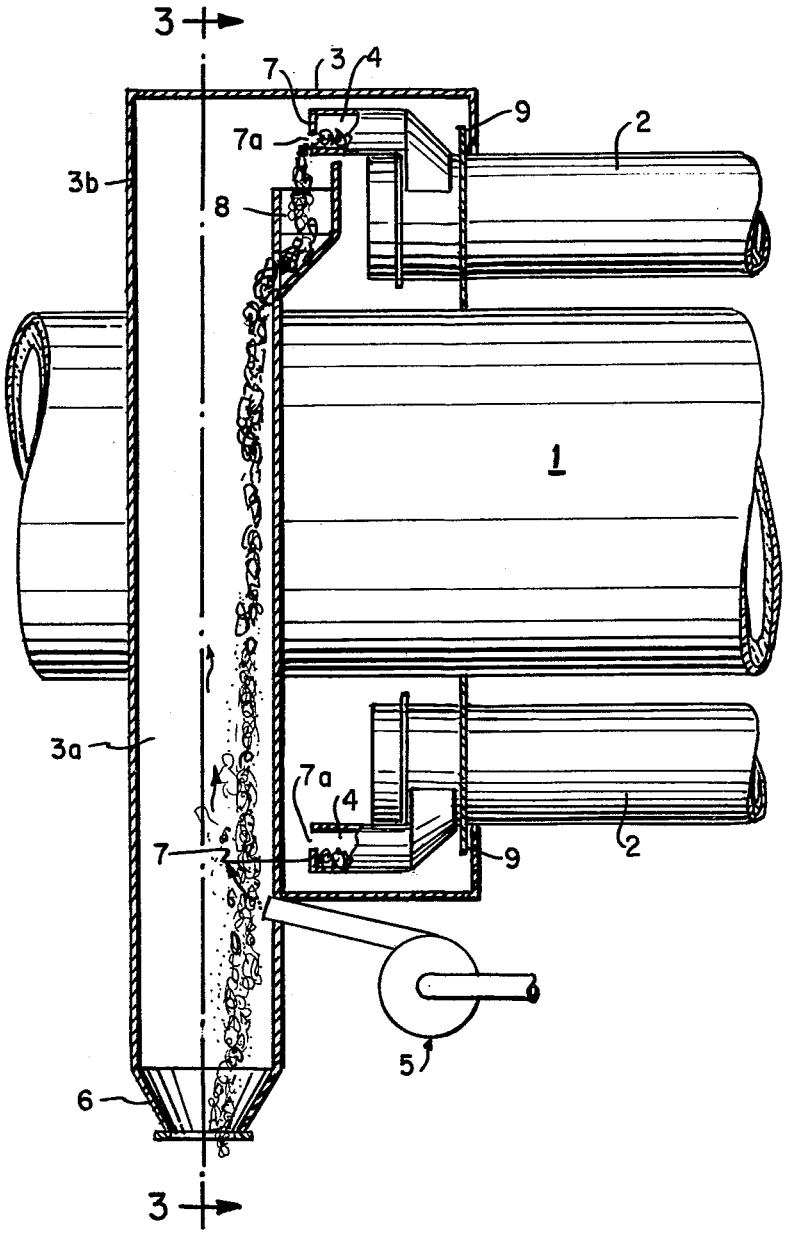
FIG. 2 is a side elevational view, partially in cross-section, of an alternate embodiment of the invention in which all of the cooling air used in the outlet casing passes through the cooler tubes.
Figure 3:
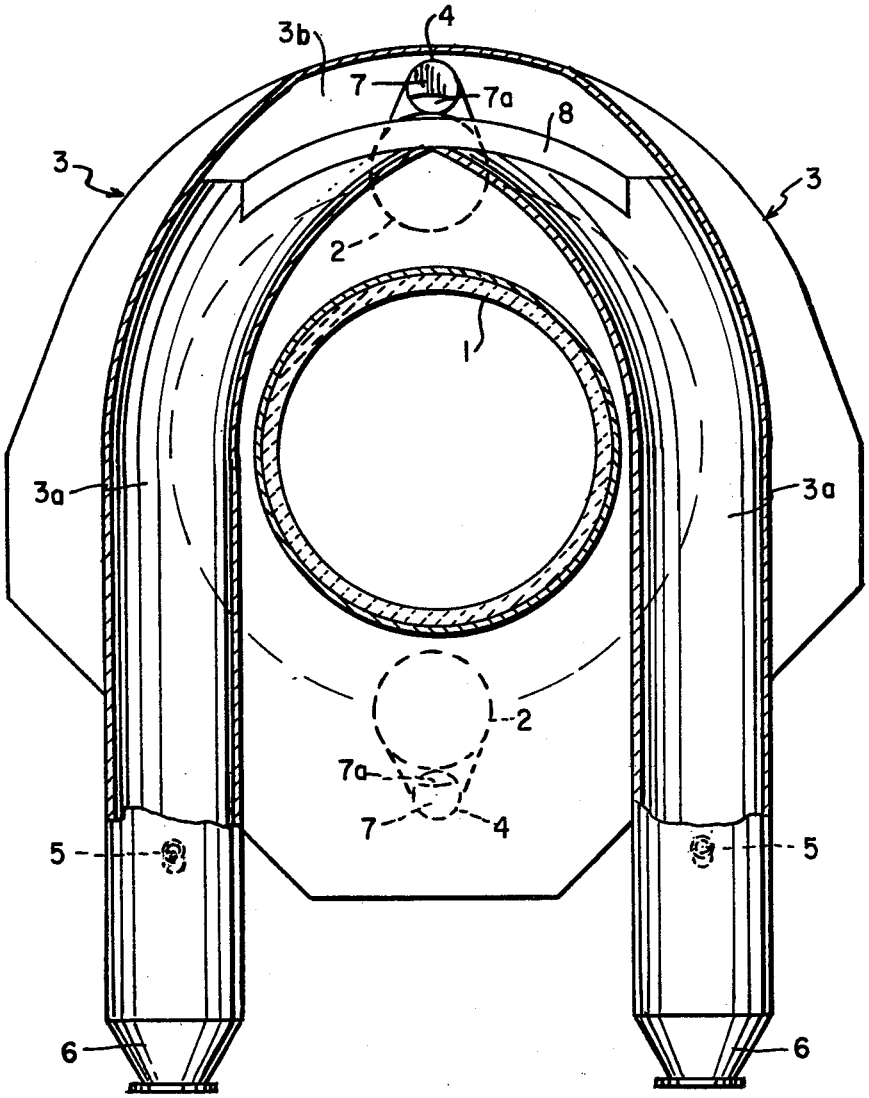
FIG. 3 is a cross-sectional view taken along lines 3—3 of FIG. 2.

The kiln product which moves from right to left as seen in FIGS. 1 and 2, passes through the inlets 10 into the cooler tubes 2. When the tubes are in their lower position the partly cooled product will pass from the individual tube into the outlet retainer 4 where it is temporarily stored. The outlet retainer 4 has an end wall 7 provided with an opening *7a*, and is designed in such manner that the kiln product passes through grated opening 4*a* and is collected in the outlet retainer, thus being stored while partaking in the rotation to the upper position of the tube. In this position the tube is emptied of the kiln product, which via the opening *7a* runs out into a funnel-shaped channel 8 when the outlet 4 passes over the channel. As a result, the kiln product is distributed in the channel, hence moving down through the shafts 3*a* on either side of the kiln 1. Due to the cooling air supplied by the fans 5, the cooling of the kiln product continues during its passage down through the shafts.

Openings 11 are provided at the ends of tubes 2. These openings are covered by fine-meshed grates preventing clinker from passing therethrough out of the tubes and only permitting supplementary, atmospheric air to pass into the tubes to be used as cooling air. According to this construction, only part of the cooling air directed to the shafts 3*a* from fan 5 will pass countercurrently to the clinker stream into the tubes 2 via the outlets 4 while another part of the cooling air is directed through tube 12 for other known use in the plant. Thus it is necessary to lead supplementary cooling air into the tubes both in order to obtain the desired cooling effect in same and in order to provide the necessary combustion air for the process taking place in the kiln.

The shafts 6 may be provided with known means for controlling the amount of air flow in such manner as to maintain in the shafts such a low air pressure that no false air is sucked into the shaft or shafts at seals 9 between the outlet casing and kiln (FIG. 2). Further the shafts may be provided with known means like louvre dampers, flash-countercurrent cooling devices, a charge or charges of material for countercurrent cooling, fluid-bed cooling devices or arrangements for indirect cooling of the kiln product in order to improve the cooling capacity in the shafts. Being of known constructions neither the control mechanism for regulating the air pressure nor the aforesaid special cooling devices in the shafts 3*a* are shown in the figures.

I claim:

1. A planetary cooler system for cooling hot material such as cement clinker exiting from a rotary kiln which comprises a plurality of cooler tubes mounted in planetary fashion about the rotary kiln, each tube having a material inlet end portion communicating with a material outlet end portion of the kiln and a material outlet end portion, at least one elongated conduit positioned generally upright and having an opening in its upper end portion, said opening being positioned generally opposite the position of each cooler tube when the tube is generally at its uppermost position such that as each cooler tube rotates to its approximate uppermost position, material passes from the material outlet end portion of said tube, through said opening and into said elongated conduit for passage through the elongated conduit, and means for controlling a flow of cooling air through said conduit to provide further cooling of the hot material as it passes therethrough.

2. The planetary cooler system according to claim 1 further comprising means to retain material at or near the material outlet end portion of each cooler tube when said tube is positioned at locations other than at or near its uppermost position.

3. The planetary cooler system according to claim 1 wherein said conduit is defined by a shaft.

4. The planetary cooler system according to claim 3, wherein said shaft further comprises a funnel-shaped channel member positioned and configured to receive partially cooled kiln product from the material outlet end portion of each cooler tube and for conveying the partially cooled material into the opening in the upper end portion of the conduit.

5. The planetary cooler system according to claim 1 further comprising means to direct cooling air through the conduit so as to cause at least a portion of the cooling air to bypass the planetary cooler tubes so as to be adaptable for other use in the plant.

6. The planetary cooler system according to claim 4 further comprising means to direct cooling air through the conduit so as to cause at least a portion of the cooling air to bypass the planetary cooler tubes so as to be adaptable for other use in the plant.

7. The planetary cooler system according to claim 1 further comprising means to direct cooling air into said shaft in countercurrent flow to the kiln product and through the planetary cooler tubes so as to be directed to the kiln to serve as combustion air therein.

8. The planetary cooler system according to claim 4 further comprising means to direct cooling air into said shaft in countercurrent flow to the kiln product and through the planetary cooler tubes so as to be directed to the kiln to serve as combustion air therein.

9. The planetary cooler system according to claim 1 wherein said conduit is defined by at least two shafts joined at their upper end portions and means being positioned adjacent the lower portion of at least one shaft to control the amount and flow of cooling air through each shaft in a manner to maintain a predetermined subatmospheric pressure therein so as to prevent false air from entering therein.

10. The planetary cooler system according to claim 4 wherein said conduit is defined by at least two shafts joined at their upper end portions and means being positioned adjacent the lower portion of at least one shaft to control the amount and flow of cooling air through each shaft in a manner to maintain a predetermined subatmospheric pressure therein so as to prevent false air from entering therein.

11. The planetary cooler system according to claim 7 wherein said conduit is defined by at least two shafts joined at their upper end portions and means being positioned adjacent the lower portion of at least one shaft to control the amount and flow of cooling air through each shaft in a manner to maintain a predetermined subatmospheric pressure therein so as to prevent false air from entering therein.

12. A planetary cooler system for cooling hot cement clinker exiting from a rotary kiln which comprises a plurality of cooler tubes mounted in planetary fashion about the rotary kiln, each tube having a material inlet end portion communicating with a material outlet end portion of the kiln and a material outlet end portion, a material outlet casing communicating with said planetary cooler tubes, said casing comprising at least two generally vertical shafts joined at their upper end portions, said shafts having an opening at said upper joined end portions, said opening being positioned generally opposite the position of each cooler tube when the tube is generally at its uppermost position such that as each cooler tube rotates to its approximate uppermost position, material passes from the material outlet end portion of said tube, through said opening and into said shafts, a funnel-shaped channel member positioned adjacent said shafts at or near the uppermost position of said cooler tubes and adapted to receive the hot material therefrom for conveyance through said shafts, means to assist the transfer of hot material from each cooler tube to the funnel-shaped channel member when the cooler tube is positioned at or near its uppermost location, fan means for controlling a flow of cooling air through at least one of said shafts, said fan means being positioned adjacent the lower portion of at least one shaft and adapted to direct cooling air therein in a direction countercurrent to the flow of material in said shaft, means to permit at least a portion of the cooling air to flow through said cooler tubes countercurrently to the flow of cement clinker and to enter said kiln for use as combustion air, and means to direct at least a portion of said cooling air out of said casing so as to bypass said cooler tubes for other use in the kiln plant.

13. The planetary cooler system according to claim 12 further comprising means to retain material at or near the material end portion of each cooler tube when said tube is positioned at locations other than at or near its uppermost position.

14. A planetary cooler system for cooling hot cement clinker exiting from a rotary kiln which comprises a plurality of cooler tubes mounted in planetary fashion about the rotary kiln, each tube having a material inlet end portion communicating with a material outlet end portion of the kiln and a material outlet end portion, a material outlet casing communicating with said planetary cooler tubes, said casing comprising at least two generally vertical shafts joined at their upper end portions, said shafts having an opening at their upper joined end portions, said opening being positioned generally opposite the position of each cooler tube when the tube is generally at its uppermost position such that as each cooler tube rotates to its approximate uppermost position, material passes from the material outlet end portion of said tube, through said opening and into said shafts, a funnel-shaped channel member positioned adjacent said shafts at or near the uppermost position of said cooler tubes and adapted to receive the hot material therefrom for conveyance through said shafts, means to assist the transfer of hot material from each cooler tube to the funnel-shaped channel member when the cooler tube is positioned at or near its uppermost location, fan means for controlling a flow of cooling air through at least one shaft, said fan means being positioned adjacent the lower portion of at least one shaft and adapted to direct cooling air therein in a direction countercurrent to the flow of material in said shafts, means to direct substantially all of the cooling air to flow from said casing through said cooler tubes countercurrently to the flow of cement clinker and to enter said kiln for use as combustion air.

15. The planetary cooler system according to claim 14 further comprising means to retain material at or near the material end portion of each cooler tube when said tube is positioned at locations other than at or near its uppermost position.

16. A rotary kiln plant which comprises a rotary kiln for producing hot cement clinker, a plurality of cooler tubes mounted in planetary fashion about the rotary kiln, each tube having a material inlet end portion communicating with the material outlet end portion of the kiln and a material outlet end portion for exiting cement clinker, a material outlet casing communicating with said planetary cooler tubes, said casing comprising at least one generally vertical shaft having an opening in its upper end portion, said opening being positioned opposite the position of each cooler tube when the tube is generally at its uppermost position, and configured such that when the cooler tube rotates to its approximate uppermost position, cement clinker passes from the material outlet end portion of said tube, through said opening and into said shafts, a funnel-shaped channel member positioned at the upper portion of the casing at or near the uppermost position of said cooler tubes, said channel member communicating with the portion of each shaft near said shaft opening, to direct hot cement clinker thereto from said cooler tubes, means to assist the transfer of hot, at least partially cooled material from each cooler tube to said channel member when the respective cooler tube is positioned at or near its uppermost position, fan means communicating with at least one shaft and adapted to direct cooling air through said casing for cooling the cement clinker passing therethrough.

17. The rotary kiln plant according to claim 16 wherein said casing defines at least two generally vertical shafts joined at the upper end portions, said shaft opening being positioned at the joined portion of said shafts and opposite the position of each cooler tube when each tube is positioned approximately in its uppermost position, each shaft having fan means communicating therewith and adapted for controlling the flow of cooling air therethrough.

18. The rotary kiln plant according to claim 17 wherein said fan means communicates with a lower portion of at least one shaft and is adapted to direct cooling air therethrough in a direction countercurrent to the flow of cement clinker therein, means being provided to direct at least portions of said cooling air to said cooler tubes to be directed to said kiln for use as combustion air therein.

19. The planetary cooler system according to claim 18 further comprising means to retain material at or near the material outlet end portion of each cooler tube when said tube is positioned at locations other than at or near its uppermost position.

* * * * *